United States Patent [19]

Olesen et al.

[11] 4,024,375

[45] May 17, 1977

[54] ELECTRIC CURLING IRON

[75] Inventors: Kaj Sigård Olesen, Copenhagen; Henrik Bodtcher-Hansen, Charlottenlund, both of Denmark

[73] Assignee: H. Bodtcher-Hansen A/S, Copenhagen K, Denmark

[22] Filed: Nov. 4, 1975

[21] Appl. No.: 628,779

[30] Foreign Application Priority Data

Nov. 19, 1974 Denmark ..... 6010/74
Sept. 19, 1975 Denmark ..... 4220/75

[52] U.S. Cl. ..... 219/225; 132/34 R; 132/37 R; 219/230; 219/533

[51] Int. Cl.[2] ..... H05B 1/00; A45D 1/04; A45D 2/00

[58] Field of Search ..... 219/222–226, 219/533, 230; 132/33 R, 34 R, 37 R, 31 R

[56] References Cited

UNITED STATES PATENTS

| | | | |
|---|---|---|---|
| 397,159 | 2/1889 | Weldon | 132/37 R |
| 1,210,018 | 12/1916 | Trood | 219/225 X |
| 1,407,937 | 2/1922 | Fitzgerald | 219/225 UX |
| 1,630,078 | 5/1927 | Smith | 132/34 R |
| 1,639,015 | 8/1927 | Velten | 132/34 R |
| 3,534,392 | 10/1970 | Trouilhet | 219/225 |
| 3,805,811 | 4/1974 | Dorn | 219/222 UX |

FOREIGN PATENTS OR APPLICATIONS

| | | | |
|---|---|---|---|
| 1,457,466 | 4/1969 | Germany | 132/37 R |

*Primary Examiner*—A. Bartis
*Attorney, Agent, or Firm*—Mason, Fenwick & Lawrence

[57] ABSTRACT

A curling iron with a stationary handle portion and a rotary handle portion mounted on the stationary handle portion has a hollow heat-conducting tube extending from the rotary handle portion with hair clamping means being pivotally connected to the heat-conducting tube and an electric heating element being mounted internally of the heat-conducting tube. The rotary handle portion can be turned by a finger of the hand of a user holding the stationary handle portion with the outer end of the heat-conducting tube being supported by the other hand of the user engaged with a knob-like supporting member which is mounted for rotation on a bearing bushing having a bifurcated end on which the support means is mounted with the bearing bushing being clamped to the outer end of the heat-conducting tube.

2 Claims, 7 Drawing Figures

ELECTRIC CURLING IRON

Figure 1:
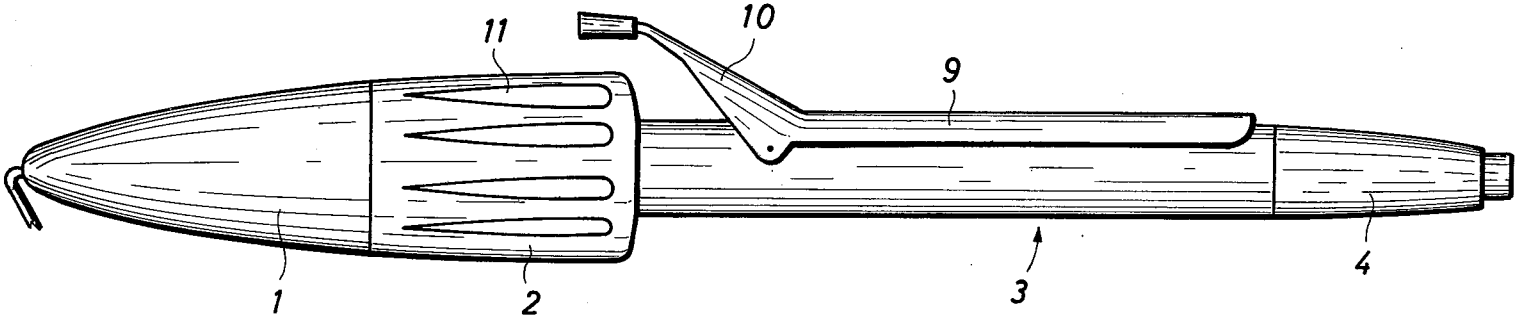

The invention relates to an electric curling iron comprising a stationary rotary handle portion, and a handle portion adapted to rotate relative thereto, the latter being rigidly connected to a first or external heat-conducting tube for emission of heat, an outer pivotal hair clamping plate mounted on said tube, and a heating element arranged in the inner portion of said first heat-conducting tube.

U.S. Pat. No. 1,630,078 discloses an electric curling iron of the above type, in which the heat-conducting rotatable tube is carried through the rotatable handle portion into the stationary handle portion, where it is clasped in the axial direction by means of a spring. Said curling iron makes it possible to roll up hair by movement of only one finger. A drawback to this curling iron is, however, that when rolling up the hair the shaft cannot be supported by the other hand, since there is no stationary supporting member at the end of the rotatable tube.

The object of the invention is therefore to provide a curling iron of the type making it possible to roll up hair by movement of only one finger, the shaft simultaneously being supported by the other hand.

The curling iron according to the invention is characterized in that it further comprises a second heat-conducting tube situated in the first tube, said second heat-conducting tube surrounding the heating element and being rigidly connected to the stationary handle portion at one end, and at the other end being rigidly connected to a supporting member. Thus the stationary handle portion may be supported by the other hand at the stationary supporting member during the rolling of the hair. Consequently, it is possible to effect the rolling of the hair much more quickly than was previously the case while retaining the axis of rotation of the iron in a relatively fixed position by supporting the outer end of the tube on which the hair is rolled so as to achieve a uniform rolling of the hair on the tube.

In order to prevent the rotatable handle portion from being heated the second heat-conducting tube may be connected to the stationary handle portion via a cylinder of heat-insulating material such as Bakelite.

Furthermore according to the invention the heat-insulating cylinder and the stationary handle portion may advantageously be formed in one piece, thus reducing the number of components and consequently the production price of the curling iron.

Moreover according to the invention the second heat-conducting tube may advantageously be secured by a clamping effect in a recess in the heat-insulating cylinder, thus eliminating the cost of additional securing means for the heat conducting tube.

In a second embodiment, a support member is mounted for rotation on the outer end of the external heat conducting tube so that the support member can be held by the hand of a user while the tube is being rotated so as to permit the axis of the tube to remain relatively stationary during the winding of hair onto the external heat conducting tube. The outer support member is mounted on a bushing received in the end of the external heat conducting tube so that the outer support member can be held stationary while the tube is rotated. The bushing is made of resilient material including a bifurcated end portion which permits the outer support member to be easily mounted thereon or to be removed if necessary. The resilient material of which the bearing bushing is formed may furthermore according to the invention be either of polyamide intensified by fibre glass or of polyphenylenoxide. Said materials have shown up to be very suitable.

Furthermore according to the invention the bushing may be secured in the first heat-conducting tube by clamping effect, the periphery of the bushing being provided with a groove for receiving a clamping ring, preferably an incomplete steel ring, clamping towards the inner surface of the tube. This results in the bearing bushing being safely secured.

In order to center the bearing bushing during the introduction into the first heat-conducting tube, and in order to provide a certain thermal resistance between said first heat-conducting tube and the bushing, the periphery of the bushing may be provided with longitudinal ribs.

Figure 2:
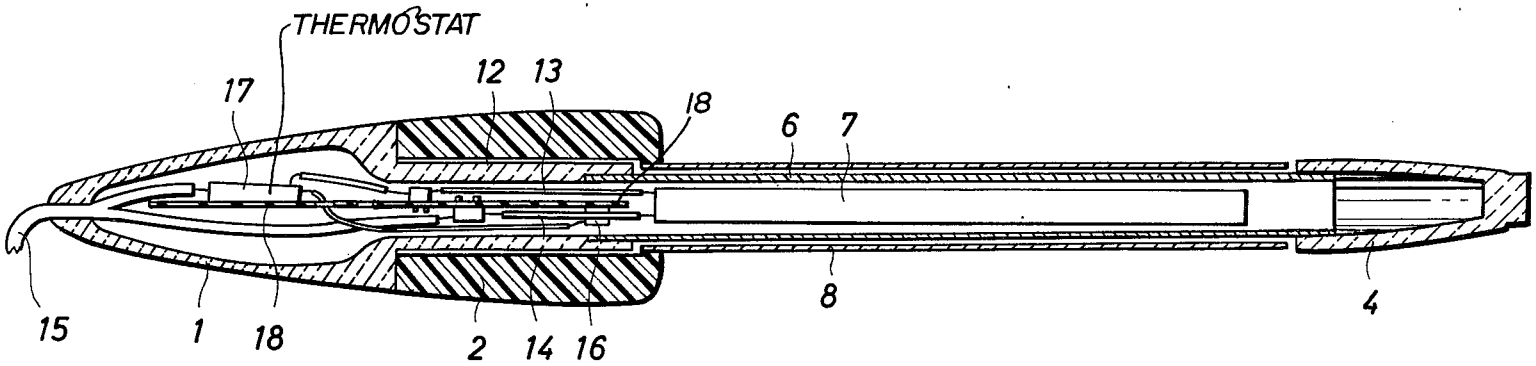
Figure 3:
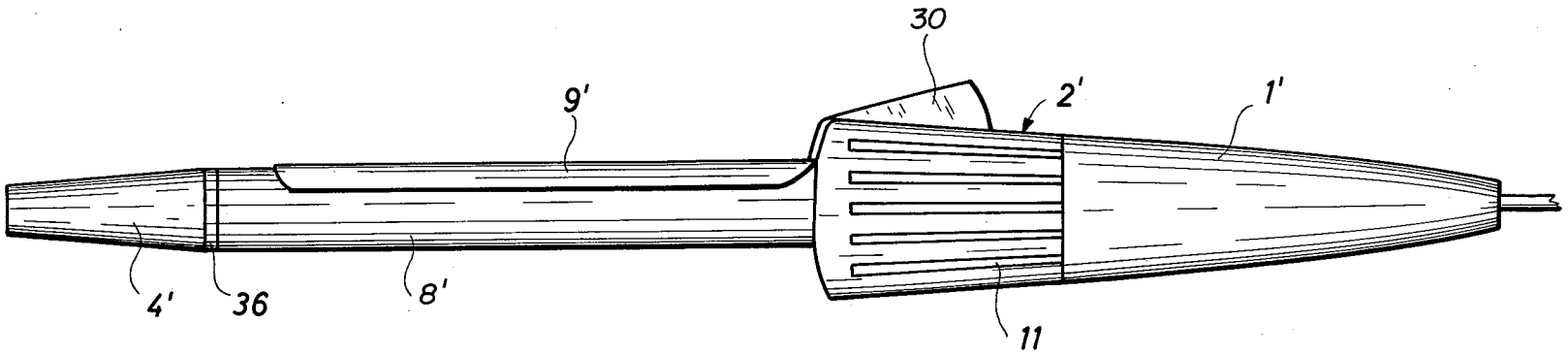
Figure 6:
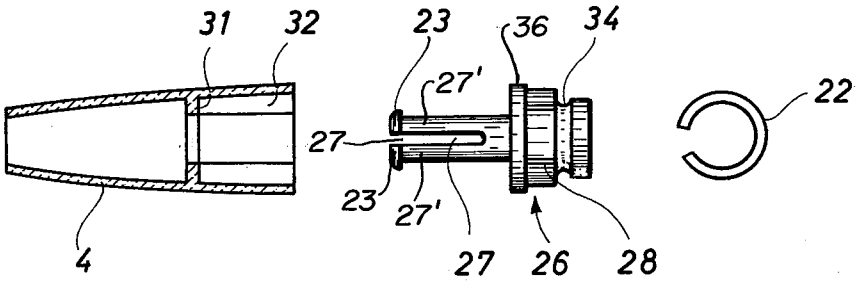
Figure 4:
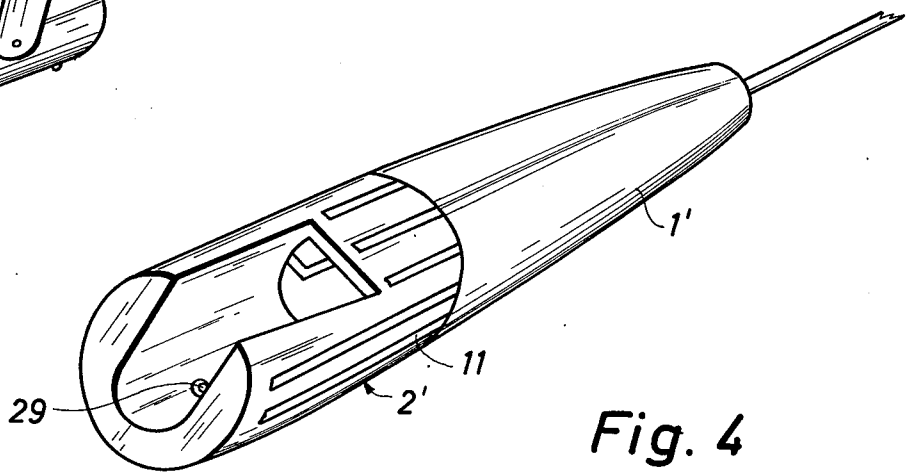
Figure 5:
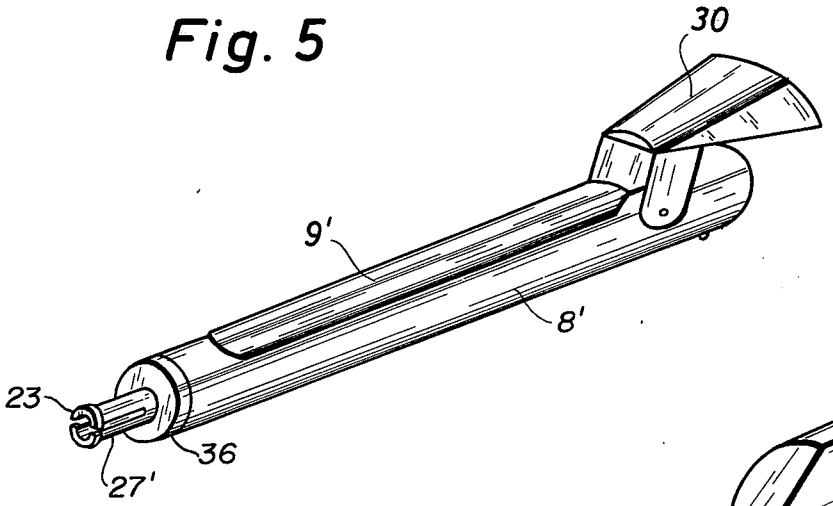
Figure 7:
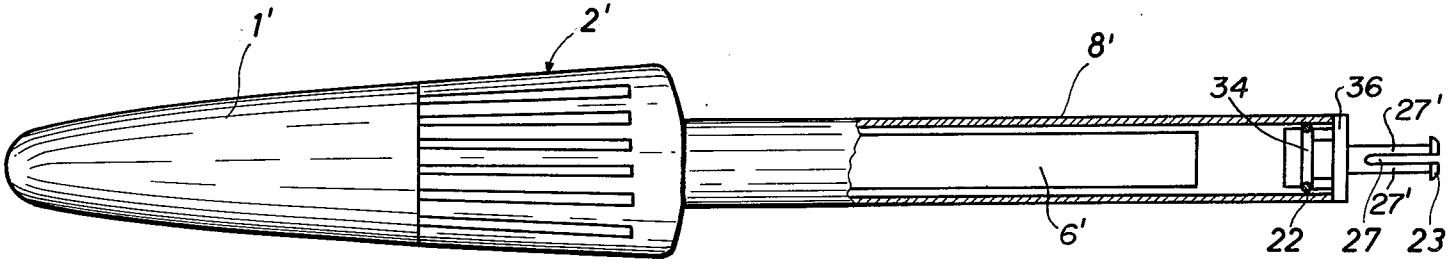

The invention will further be described below with reference to the accompanying drawings, in which FIG. 1 shows the electric curling iron according to the invention, FIG. 2 is a sectional view of the curling iron, FIG. 3 is an alternative embodiment of the curling iron, FIG. 4 shows the respective handle portion, FIG. 5 shows the heat emitting shaft secured to the handle portion, FIG. 6 shows the supporting member and its bearing bushing situated at the end of the shaft, and FIG. 7 shows the curling iron partly in section.

Attention is initially invited to FIGS. 1 and 2 of the drawings which illustrate a first embodiment of the invention which includes a stationary handle portion 1 and a rotary handle portion 2 mounted for relative rotation thereon. The rotary handle portion 2 is rigidly connected to a first or external rotatable heat conducting tube 8 adapted for heat emission. The curling iron furthermore comprises a second heat-conducting tube 6 situated in the first heat-conducting tube 8 and surrounding a heating element 7. The second heat-conducting tube 6 is rigidly connected to the stationary handle portion 1 at one end and at the other end rigidly connected to a supporting member 4. The heating element 7 extends preferably in the entire length of the inner tube 6. A hair clamping plate 9 having a curved sectional shape to conform to the outer surface of the rotatable heat-conducting tube 8 is pivotally mounted on the tube 8 for movement about a pivot axis 10' and can be pivoted away from the tube 8 by pressing on an arm 10 extending unitarily upwardly and outwardly from the curved clamping plate 9 as shown in FIG. 1. In use, the arm 10 is depressed to move the hair clamping plate 9 away from the tube 8 in order that the ends of the strands of hair to be curled can be positioned on the tube 8 and then clamped in position by release of the arm 10. Spring means, not shown, maintains the hair clamping plate 9 in position to hold the ends of hair to be curled clamped between members 9 and 8 in an obvious manner.

Longitudinal grooves are provided in the outer surface of the rotatable handle portion 2 so that the rotatable handle portion can be rotated by the forefinger and the thumb of the user or simply by the thumb alone if desired. The rotatable handle portion 2 is protected from the heat from heating element 7 by a cylinder portion 12 of heat-insulating material which can be formed unitarily with the stationary handle portion 1 if desired as shown in FIG. 2.

A sheet 18 of insulating material may advantageously be inserted in the stationary handle portion 1, said sheet being provided with means for joining the supply lines 13 and 14 of the heating element 7 and the conductors of the power supply conductor 15. In order to avoid short-circuit one joint may be situated on one side of the sheet 18 and another joint on the other side of said sheet. The joining means may advantageously be "crown muffs", the tightening screws of which may secure the muffs to the sheet 18. Said screws may be made of insulating material.

The inner portion of the stationary handle portion 1 may moreover be provided with a thermostat 17 having a temperature detector 16 situated adjacent the inner second heat-conducting tube 6. Said thermostat 17, which is also mounted on the insulating sheet 18, is adapted to keep the temperature of the curling iron within a predetermined interval. Furthermore the stationary handle portion 1 may be provided with a light indicator indicating whether the curling iron is turned on or off.

In a very advantageous embodiment of the curling iron the inner second heat-conducting tube 6 is not introduced completely into the stationary handle portion 1, as one end of the insulating cylinder 12 has been provided with a circular recess, in which the second heat-conducting tube 6 may be secured, e.g. by clamping effect. This provides a further protection of the rotating portion, and prevents electric components from being situated adjacent a metallic surface in so far as the heat-conducting material is a metal which might cause short-circuit.

When using the curling iron a lock of hair is fixed between the outer clamping arm 9 and the first heat-conducting tube 8. Then the rotatable handle portion 2 and the first heat-conducting tube 8 are turned by means of the forefinger and the thumb or the thumb only. This rotation is rather easy to perform as it is unnecessary to use the whole hand. During the rotation it is possible to support the curling iron with the other hand, thus permitting a rapid rolling up. Furthermore the axis of rotation of the curling iron may constantly be kept still during the rolling up.

The handle portions 1 and 2 are preferably made of plastics or Bakelite.

FIGS. 3 through 7 illustrate another embodiment of the invention including a fixed handle portion 1' and a modified rotatable handle portion 2'. An outer supporting member 4' is mounted on the outer end of a modified external tube 8' for rotation on and with respect to tube 8'. A bushing member 26 is inserted in the outer end of the tube 8' to provide rotary support for support 4; as shown in FIG. 7. Bushing member 26 has a cylindrical portion 28 which is inserted into the end of the external heat conducting tube 8' to a final position in which a positioning flange 36 engages the end of tube 8' as shown in FIG. 7. A peripheral circular groove 34 on bushing 26 receives a steel retaining ring 22 which expands outwardly against the inner surface of tube 8'. A coating of epoxy resin such as Araldite is applied to the ring 22 before the bushing 26 is inserted in the tube 8' to provide for a permanent mounting of the bushing in the tube.

Bushing 26 has a bifurcated end portion consisting of two prongs 27' on the ends of which retaining lips 23 are provided. The prongs 27' can be compressed toward each other to permit the outer end of rotary supporting member 4' to be inserted over the prong member 27' to a point at which the retaining lips 23 move past an internal radial flange 31 and snap in position to retain the member 4' on the prongs 27' while permitting rotation of the member 4' with respect to the bushing 26. Radial ribs 32 on the interior of rotary support 4' engage the prongs 27' to provide rotary support for support 4' thereon. However, member 4 can be removed from the supporting bushing 26 by pressing down perpendicularly to the groove 27 so as to bend one of the prong members 27' and permit the member 4' to be removed from bushing 26. Bushing 26 is formed of resilient material such as polyamide including fiberglass or polyphenylenoxide so as to be capable of withstanding a temperature of approximately 170° C. Longitudinally extending ribs are provided in the cylindrical portion 28 of bushing 26 so that an air space is provided between cylindrical portion 28 and the inner surface of the external heat conducting tube 8'.

The heating element employed in the embodiment of FIGS. 3 through 7 is enclosed in a relatively short tube 6' mounted in the handle portion 1 in the same manner as the first embodiment so that external tube 8' can rotate about the heating element in the same manner as in the first embodiment with the electrical connections and the thermostat controls being provided in essentially the same manner as in the first embodiment.

External heat conducting tube 8' is supported solely by the rotatable handle portion 2 and is retained in position thereon by means of a screw 29 engageable with the tube 8' in a manner that will be apparent from inspection of FIG. 4. It will be noted that the rotatable member 2' is provided with a slot in which an arm 30 of a hair clamping plate 9' is positioned as shown in FIG. 3.

Therefore, it will be seen that the second embodiment provides a curling iron that is lighter than the first embodiment by virtue of the elimination of the long tube 6 of the first embodiment. Moreover, the second embodiment is easier to use in that the outer heated tube 8' is easily rotated by the thumb and/or forefinger of the user engaging the rotatable handle portion 2' while the outer end of the iron is easily supported by member 4' which does not provide any resistance to the rotation of tube 8'. Numerous modifications of the invention will undoubtedly occur to those of skill in the art and it should therefore be understood that the spirit and scope of the invention is to be limited solely by the appended claims.

We claim:

1. An electrical curling iron including a stationary handle portion, a rotary handle portion mounted for rotation on said stationary handle portion, a heat-conducting tube rigidly connected at one end to said rotary handle portion, hair clamping means pivotally mounted on said heat-conducting tube, a heating element mounted internally of said heat conducting tube, hand engageable support means mounted adjacent the other end of said heat-conducting tube for permitting the axis of said heat-conducting tube to be stabilized by one hand of a user while said rotary handle portion and said heat-conducting tube are rotated as a unit by the index finger and/or the thumb of the other hand of a user holding said stationary handle portion, rotary bearing means rotatably connecting said hand engageable support means to said heat-conducting tube to permit relative rotation of said hand engageable support means with respect to said heat-conducting tube about the axis of said heat-conducting tube, said rotary bearing means comprising a bearing bushing made of resilient material secured in the heat-conducting tube by a clamping effect, the periphery of the bearing bushing being provided with a groove receiving an expandable clamping ring having portions urged outwardly towards the inner surface of said heat-conducting tube and wherein said rotary bearing means has an outer bifurcated end on which a mating portion of said hand engageable support means is received for permitting relative rotation of said hand engageable support means and said heat-conducting tube while retaining said hand engageable support means.

2. The invention of claim 1 wherein said bifurcated end includes first and second prong members separated by a slot and retaining lips on the outer ends of said prong members to retain said hand engageable support means thereon.

* * * * *